US009821972B2

(12) United States Patent
Tseng

(10) Patent No.: US 9,821,972 B2
(45) Date of Patent: Nov. 21, 2017

(54) SHEET CONVEYING SYSTEM

(71) Applicant: SHANGHAI ETERNAL MACHINERY CO., LTD, Shanghai (CN)

(72) Inventor: Whah Tseng, Shanghai (CN)

(73) Assignee: SHANGHAI ETERNAL MACHINERY CO., LTD., Shanghai (CN)

( * ) Notice: Subject to any disclaimer, the term of this patent is extended or adjusted under 35 U.S.C. 154(b) by 0 days.

(21) Appl. No.: 15/105,256

(22) PCT Filed: Jul. 21, 2014

(86) PCT No.: PCT/CN2014/000689
§ 371 (c)(1),
(2) Date: Jun. 16, 2016

(87) PCT Pub. No.: WO2015/089898
PCT Pub. Date: Jun. 25, 2015

(65) Prior Publication Data

US 2017/0001820 A1 Jan. 5, 2017

(30) Foreign Application Priority Data

Dec. 16, 2013 (CN) ..... 2013 1 0694605

(51) Int. Cl.
*B65H 5/00* (2006.01)
*B65H 5/10* (2006.01)
(Continued)

(52) U.S. Cl.
CPC ..... *B65H 5/10* (2013.01); *B41F 21/00* (2013.01); *B65H 9/08* (2013.01); *B65H 9/20* (2013.01);
(Continued)

(58) Field of Classification Search
CPC ..... B65H 5/02; B65H 5/021; B65H 5/028; B65H 5/08; B65H 5/085; B65H 5/10; B65H 29/003
(Continued)

(56) References Cited

U.S. PATENT DOCUMENTS 5,667,214 A * 9/1997 Belec ..... B65H 9/166 198/416
6,158,735 A * 12/2000 Cote ..... B65H 29/6654 198/418.8
(Continued)

FOREIGN PATENT DOCUMENTS

CN 1576040 2/2005
CN 1576040 A 2/2005
(Continued)

OTHER PUBLICATIONS

International Search Report and Written Opinion of International Patent Application PCT/CN2014/000689 dated Oct. 15, 2014.
(Continued)

*Primary Examiner* — Prasad Gokhale
(74) *Attorney, Agent, or Firm* — Troutman Sanders LLP; James E. Schutz; Tiffany N. Palmer

(57) ABSTRACT

The present invention includes a sheet transmission system, comprising: a sheet stacking unit, a sheet position adjusting unit, a sheet processing unit, and a sheet collection unit, arranged in series along a transmission path of a sheet; and one or more independent transmission units, each transmission unit provided between two adjacent units among above units; wherein the sheet stacking unit is configured to store the sheet to be processed; the sheet position adjusting unit is configured to adjust the position of the sheet; the sheet processing unit is configured to conduct a predetermined process to the sheet transmitted therein; the sheet collection unit is configured to collect the processed sheet; wherein
(Continued)

when a sheet is transmitted along the transmission path, the sheet is subjected to at least one transition between the first-direction transmission state and the second-direction transition state; and wherein the sheet will not deflect in a vertical direction.

19 Claims, 3 Drawing Sheets

(51) Int. Cl.
*B41F 21/00* (2006.01)
*B65H 29/00* (2006.01)
*B65H 9/08* (2006.01)
*B65H 9/20* (2006.01)

(52) U.S. Cl.
CPC .... *B65H 29/003* (2013.01); *B65H 2301/3411* (2013.01); *B65H 2301/4212* (2013.01); *B65H 2301/5111* (2013.01); *B65H 2301/5114* (2013.01); *B65H 2301/5152* (2013.01)

(58) Field of Classification Search
USPC ..... 271/225
See application file for complete search history.

(56) References Cited

U.S. PATENT DOCUMENTS

| | | | | |
|---|---|---|---|---|
| 6,406,014 | B1 * | 6/2002 | Reist | B65H 29/005 271/101 |
| 7,213,808 | B2 * | 5/2007 | Botschek | B43M 3/00 271/184 |
| 2005/0067766 | A1 * | 3/2005 | Ikehata | B65H 29/20 271/225 |
| 2007/0126175 | A1 * | 6/2007 | Masotta | B65H 29/12 271/225 |
| 2009/0127774 | A1 * | 5/2009 | Sugahara | F16H 19/0622 271/225 |

FOREIGN PATENT DOCUMENTS

| | | | |
|---|---|---|---|
| CN | 1663795 | | 9/2005 |
| CN | 1663795 | A | 9/2005 |
| CN | 2765770 | | 3/2006 |
| CN | 2765770 | Y | 3/2006 |
| CN | 202321709 | | 7/2012 |
| CN | 202321709 | U | 7/2012 |
| CN | 103101791 | | 5/2013 |
| CN | 103101791 | A | 5/2013 |
| CN | 203682682 | | 7/2014 |
| CN | 203682682 | U | 7/2014 |
| JP | 04-16446 | A | 1/1992 |
| JP | D4-16446 | | 1/1992 |
| JP | 2011111243 | | 6/2011 |
| JP | 2011111243 | A | 6/2011 |

OTHER PUBLICATIONS

International Search Report and Written Opinion of related International Patent Application PCT/CN2014/000689 dated Oct. 15, 2014.

English Translation of International Search Report and Written Opinion of related International Patent Application No. PCT/CN2014/000689 dated Oct. 15, 2014.

* cited by examiner

SHEET CONVEYING SYSTEM

CROSS-REFERENCE TO RELATED APPLICATIONS

This application is a U.S. National Stage of International Application No. PCT/CN2014/000689 filed 21 Jul. 2014, which claims the benefit of Chinese Patent Application No. 201310694605.0 filed 16 Dec. 2013, each herein fully incorporated by reference.

FIELD OF THE INVENTION

The present invention relates to a sheet transmission system.

BACKGROUND

In current industrial production, a production line constituted by multiple apparatuses arranged in order is frequently used for the processing of the sheet. In such production line, traditional mechanical transmission structures like chain wheel, swing rod and so on are usually used for the transmission of the sheet. However, restricted by the design of these traditional mechanical transmission structures, adopting such approach generally requires that the multiple apparatuses in the production line are arranged in a straight line. Further, on such occasions where mechanical transmission structures are used, the designers are required to conduct accurate calculation to each apparatus in the production line before determining the transmission speed of these mechanical transmission structures. Given that the processing time of various procedures in the production line is different, it is difficult to control the transmission speed of the sheet in the production line adopting mechanical transmission structures, which is further difficult to improve the processing speed of the whole production line.

According to above, the present invention provides a sheet transmission system as a solution to solve above problems.

SUMMARY

The object of the present invention is to provide a sheet transmission system which can solve the problems of existing sheet transmission systems, such as complex structure, large space occupation, low production efficiency, etc.

In order to achieve above target, the present invention provides a sheet transmission system, which comprises a sheet stacking unit, a sheet position adjusting unit, a sheet processing unit and a sheet collection unit arranged in order along a transmission path of a sheet, and independent transmission units each of which is provided between two adjacent units among above units.

In the sheet transmission system, the sheet stacking unit is used to store the sheet to be processed; the sheet position adjusting unit is used to adjust the position of the sheet; the sheet processing unit is used to conduct a predetermined process to the sheet transmitted therein; the sheet collection unit is used to collect the processed sheet; and each said transmission unit can conduct reciprocating-linear movement between two adjacent units along the transmission path of the sheet, so as to transmit the sheet between the two adjacent units; and the transmission path of the sheet has a first direction and a second direction orthogonal to each other, and in the process of the sheet being transmitted in the transmission path, a first-direction transmission state in which the sheet is transmitted along the first direction between two adjacent units and a second-direction transmission state in which the sheet is transmitted along the second direction between two adjacent units can be switched at least one time when the sheet is transmitted; and in the process of being transmitted, the sheet will not be deflected around a vertical direction.

By means of the sheet transmission system, the transmission direction of the sheet can be conveniently changed in the process of transmission, which greatly improves the arranging convenience of the whole system and reduces the space of the place required by the system.

Further, the transmission unit provided between the sheet stacking unit and the sheet position adjusting unit is a first transmission unit, which transmits the sheet in one of the first-direction transmission state and the second-direction transmission state between the sheet stacking unit and the sheet position adjusting unit; the transmission unit provided between the sheet processing unit and the sheet position adjusting unit is the second transmission unit, which transmits the sheet in the other of the first-direction transmission state and the second-direction transmission state between the sheet processing unit and the sheet position adjusting unit; the transmission unit provided between the sheet processing unit and the sheet collection unit is the third transmission unit, which transmits the sheet in the one of the first-direction transmission state and the second-direction transmission state between the sheet processing unit and the sheet collection unit.

Preferably, the transmission unit provided between the sheet stacking unit and the sheet position adjusting unit is the first transmission unit, which transmits the sheet in one of the first-direction transmission state and the second-direction transmission state between the sheet stacking unit and the sheet position adjusting unit; the transmission unit provided between the sheet processing unit and the sheet position adjusting unit is the second transmission unit, which transmits the sheet in the other of the first-direction transmission state and the second-direction transmission state between the sheet processing unit and the sheet position adjusting unit; the transmission unit provided between the sheet processing unit and the sheet collection unit is the third transmission unit, which transmits the sheet in the other of the first-direction transmission state and the second-direction transmission state between the sheet processing unit and the sheet collection unit.

Further, the third transmission unit can drive the sheet to freely move within the sheet processing unit. Moreover, when the sheet is processed by multiple times within the sheet processing unit, the third transmission unit drives the sheets to move within the sheet processing unit so as to be processed in order; the sheet transmission speed of the first transmission unit and the second transmission unit corresponds to the sheet transmission speed of the third transmission unit between the sheet processing unit and the sheet collection unit.

Preferably, the first transmission unit and the second transmission unit transmit the sheet by means of skip transmission or reducing the speed.

Further, the first transmission unit is an adsorption transmission unit, which transmits the sheet by means of adsorbing one side surface of the sheet.

Preferably, the adsorption transmission unit comprises a movable base, a servo motor and a linear guiderail, the movable base may be movably provided on the linear guiderail, and conducts reciprocating movement along the linear guiderail as driven by the servo motor; and at least one chuck is mounted on the movable base to adsorb one side surface of the sheet.

Further, the second transmission unit is a gripping transmission unit, which transmits the sheet by means of gripping the edge of the sheet.

Preferably, the second transmission unit comprises at least one gripping part, and each gripping part further comprises a movable base and a plurality of grippers fixed side by side on the movable base; and the movable base of each gripping part may be movably provided on a corresponding linear guiderail, and conducts reciprocating movement along the corresponding linear guiderail as driven by a corresponding servo motor.

Further, when the second transmission unit comprises a plurality of gripping parts, the gripping parts conduct intersected reciprocating movement relative to each other along each linear guiderail between the sheet processing unit and the sheet position adjusting unit.

Preferably, the third transmission unit is a gripping transmission unit, which transmits the sheet by means of gripping the edge of the sheet.

Further, the third transmission unit comprises a gripping part, which further comprises a movable base, a plurality of grippers fixed side by side on the movable base and two linear guiderails arranged orthogonally to each other; the movable base may be movably provided on one linear guiderail, and may conduct reciprocating movement along the one linear guiderail as driven by one corresponding servo motor; the one linear guiderail may be movably provided on the other linear guiderail, and may conduct reciprocating movement along the other linear guiderail as driven by another corresponding servo motor.

Preferably, the second transmission unit and the third transmission unit can grip the identical sheet at the same time.

Further, in the process of being transmitted along the transmission path, the sheet is transmitted along a horizontal direction.

Preferably, the sheet position adjusting unit comprises a first detection part, a second detection part and an adjusting and positioning part, the first detection part is used to detect the location of the edge of one side of the sheet; the second detection part is used to detect the location of the edge of the other side of the sheet; the adjusting and positioning part is used to adjust and position the location of the sheet within the sheet position adjusting unit in accordance with the detection result of the first detection part and/or the second detection part.

The sheet position adjusting unit can accurately position the sheet to be processed for the convenience of subsequent processing.

Further, the first detection part detects the positions of at least two points on the edge of one side of the sheet.

Preferably, the first detection part is a laser detection part, which detects the positions of two reference detection points on the edge of one side of the sheet.

Further, the second detection part detects the position of at least one point on the edge of the other side of the sheet.

Preferably, the second detection part is a laser detection part, which detects the position of one reference detection point on the edge of the other side of the sheet.

The first detection part and the second detection part respectively positions the edge on the two sides of the sheet to be processed, so as to accurately determine the position of the sheet.

Further, the adjusting and positioning part is a diaphragm gripping part or a vacuum attraction part; when the adjusting and positioning part is a diaphragm gripping part, the diaphragm gripping part grips the edge of the sheet to drive the sheet to move so as to adjust and locate the position of the sheet within the sheet position adjusting unit; when the adjusting and positioning part is a vacuum attraction part, the vacuum attraction part attracts one side surface of the sheets to drive the sheet to move so as to adjust and locate the position of the sheet within the sheet position adjusting unit.

Preferably, the sheet has a rectangular shape, and the first direction and the second direction respectively corresponds to the length direction and the width direction of the sheet. More preferably, the sheet is a rectangular piece of paper.

The present invention also provides a paper processing apparatus comprising any of the sheet transmission system as above.

In conclusion, the sheet transmission system provided by the present invention is simple in structure, and realizes the transmission of the sheet in a plurality of directions, saving the space occupied by the apparatus, while achieves the concurrent operation of a plurality of procedures and the improvement of the production efficiency.

In order to make the content of the present invention clear and easy to understand, the preferred embodiments of the present invention are cited hereinafter, and combined with accompanying drawings to elaborate the present invention specifically.

BRIEF DESCRIPTION OF THE DRAWINGS

Hereinafter the drawings are combined to introduce the present invention.

DESCRIPTION OF PART SYMBOL

Figure 1:
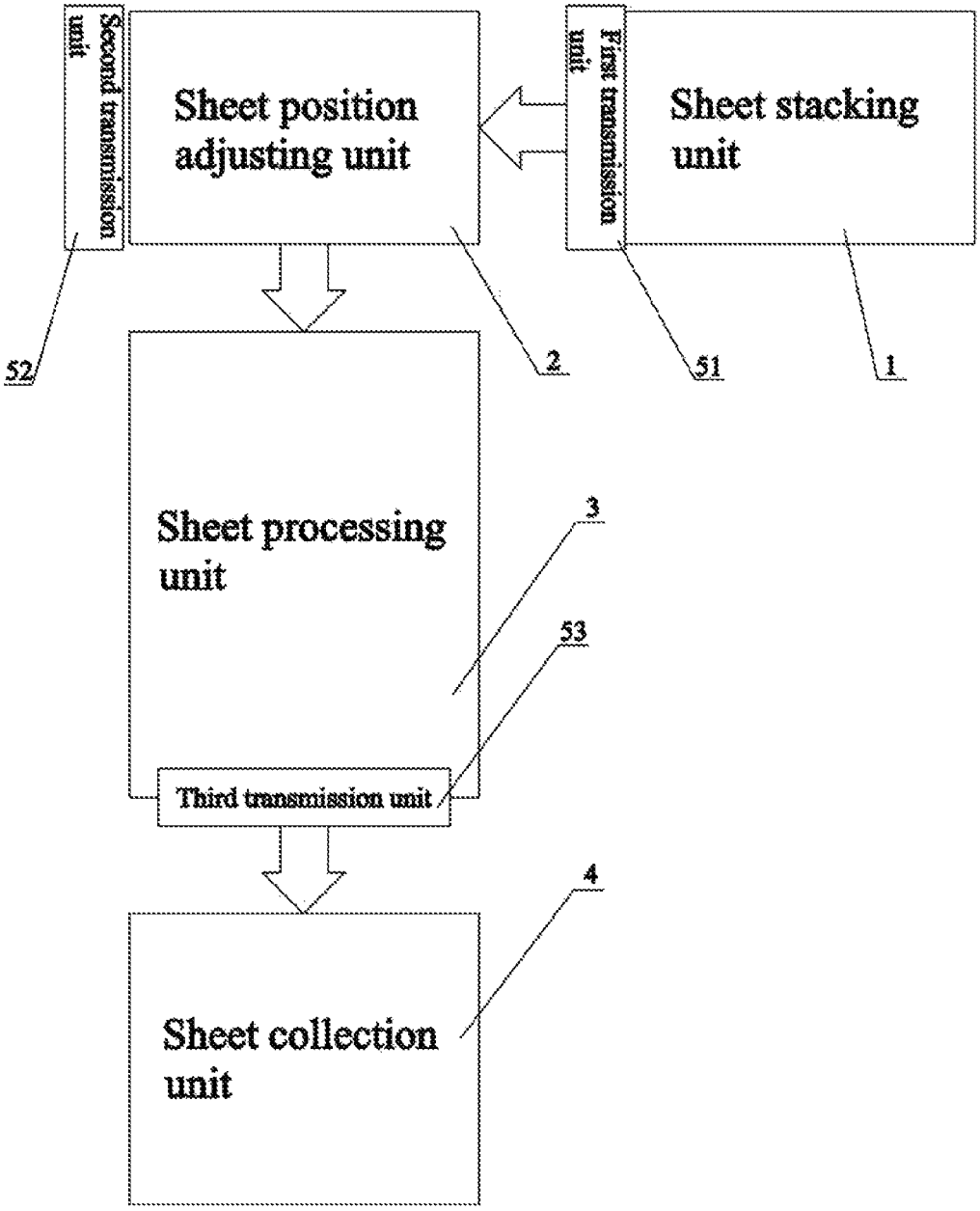
FIG. 1 shows the schematic arrangement diagram of the first embodiment according to the sheet transmission system of the present invention.

1 Sheet stacking unit
2 Sheet position adjusting unit
3 Sheet processing unit
31 First processing position
32 Second processing position
33 Third processing position
4 Sheet collection unit
51 First transmission unit
52 Second transmission unit
53 Third transmission unit

DETAILED DESCRIPTION

Specific embodiments are provided hereinafter to interpret the preferred embodiments of the present invention, and those familiar with the technology can also easily understand other advantages and functions of the present invention based on the contents disclosed in the Specification.

The present invention provides a sheet transmission system, which is used to transmit the sheet to be processed in sheet production line and to collect the processed product.

The system can be applied to various apparatuses used to process the sheet product, and can transmit the sheet to be processed to the apparatus and then collect the processed product. In the preferred embodiments of the Specification, rectangular pieces of paper are used to explain the present invention, however, the present invention is not thus limited to those preferred embodiments. It is easy for the skilled in the field to think of that the present invention can be used for the transmission of various kinds of sheets like steel sheet, resin sheet, etc.; further, the skilled in the field can also easily understand that the sheet to be transmitted may be of any shape instead of the rectangular shape cited above, like round, oval, polygonal or other shapes, as long as they are sheets.

Figure 2:
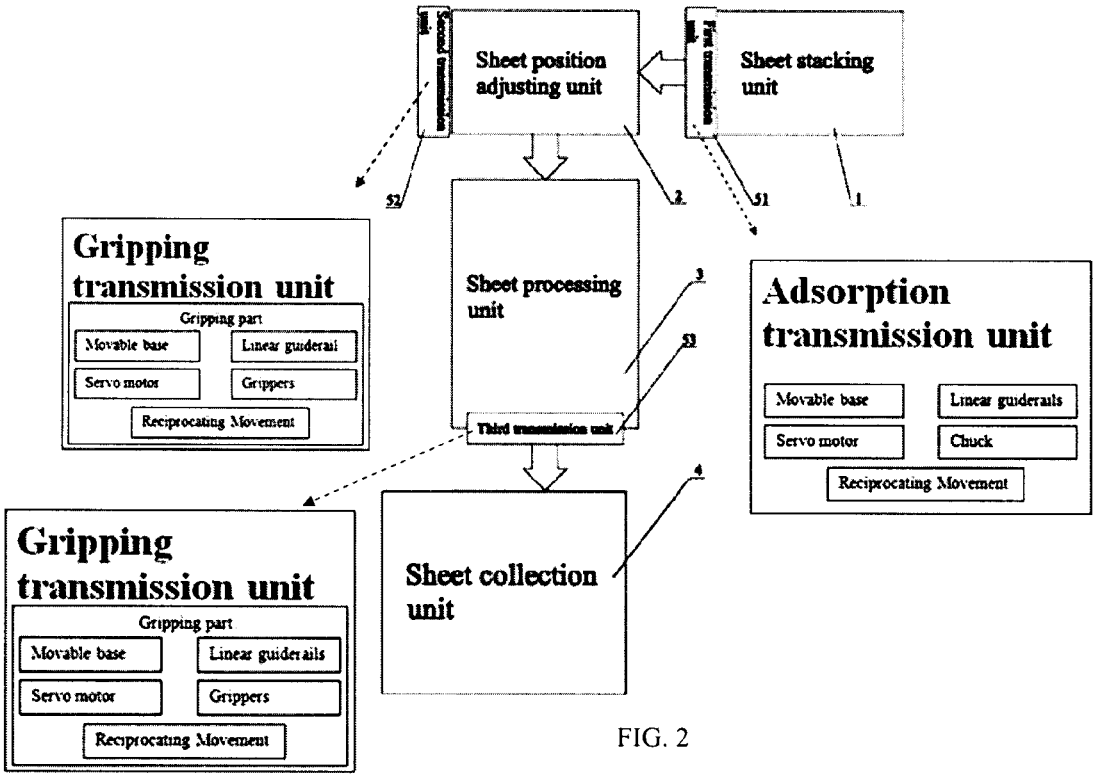
FIG. 2 shows the schematic distribution diagram of the multiple processing positions of the sheet processing unit 3 in FIG. 1.

As shown in FIG. 1 and FIG. 2, the sheet transmission system comprises a sheet stacking unit 1, a sheet position adjusting unit 2, a sheet processing unit 3 and a sheet collection unit 4 arranged in order in the transmission path of the sheet, and independent transmission units each of which is provided between two adjacent units among above units. The transmission units can transmit the sheet between two adjacent units.

More specifically, in the present invention, the sheet stacking unit 1 is used to store the sheet to be processed; the sheet position adjusting unit 2 is used to adjust the position of the sheet; the sheet processing unit 3 is used to conduct a predetermined process to the sheet transmitted therein; the sheet collection unit 4 is used to collect the processed sheet.

Further, in the sheet transmission system, each transmission unit can conduct reciprocating-linear movement between two adjacent units, so as to transmit a sheet between the two adjacent units.

More specifically, in the preferred embodiments according to the present invention, the sheet stacking unit 1 provides the space where the paper (sheet) to be processed are stored, and in the sheet stacking unit 1, the paper may be stored therein in a stack way; the sheet position adjusting unit 2 is used to adjust the position of the paper therein, so as to adjust the orientation of the paper being transmitted from the upstream position to a required orientation to enter a next unit; the sheet processing unit 3 is used to conduct a predetermined process to the sheet transmitted therein, and when the paper is transmitted into it from the sheet position adjusting unit 2 disposed on the upstream, the paper will stay in the sheet processing unit 3 for a certain period of time, so as to be conducted the predetermined process to the paper by a processing device; the sheet collection unit 4 is used to collect the processed paper, which means that the paper processed in the sheet processing unit 3 is then transmitted to the sheet collection unit 4 to be collected. Further, independent transmission units each of which is provided between two adjacent units among above units, each transmission unit may transmit the paper between two adjacent units, so that the paper can be smoothly transmitted among each unit. Such a means can assure the smooth transmission of the paper in the whole sheet transmission system. Further, even when a failure occurs in one of the transmission units, there is no need to disassemble all the other transmission units, which thus reduces the maintenance cost and the maintenance time of the transmission units.

Furthermore, in the sheet transmission system according to the present invention, each transmission unit is independent to each other, and each transmission unit can conduct reciprocating-linear movement between two adjacent units along the transmission path of the sheet to transmit the sheet therebetween. For any one of the transmission units, after transmitting the sheet to the next unit, it can timely return to its initial location and prepare for a next transmission task. Having such structure, the transmission of each transmission unit is not relevant to each other, the transmission speed of each transmission unit can be adjusted according to requirements, so as to improve the sheet transmission speed of the whole sheet transmission system.

Further on, in the sheet transmission system according to the present invention, the transmission path of the sheet has a first direction and a second direction orthogonal to each other, and in the process of the sheet being transmitted along the transmission path, a first-direction transmission state in which the sheet is transmitted along the first direction between two adjacent units and a second-direction transmission state in which the sheet is transmitted along the second direction between two adjacent units can be switched at least one time when the sheet is transmitted.

Further on, in the sheet transmission system according to the present invention, by means of the sheet transmission system, the transmission direction of the sheet can be conveniently changed direction between two adjacent units in the process of transmission, which accordingly significantly improves the degree of freedom in the arrangement of the whole system. Besides, designers may also randomly combine the arrangements of various units in accordance with the actual production space without having to consider the problem of whether the sheet can be transmitted between two adjacent units.

Further, in the sheet transmission system according to the present invention, the sheet will not be deflected around the vertical direction in the process of being transmitted. More specifically, when the sheet is being transmitted in the transmission path, it will not be deflected around the vertical direction; in other words, when the sheet is being transmitted in the transmission path, it will not be deflected by any angular with respect to the vertical direction, and what occurs is only a change of the position.

Further on, in the sheet transmission system according to the present invention, the transmission unit provided between the sheet stacking unit 1 and the sheet position adjusting unit 2 is a first transmission unit 51, which transmits the sheet in one of the first-direction transmission state and the second-direction transmission state between the sheet stacking unit 1 and the sheet position adjusting unit; the transmission unit provided between the sheet processing unit 3 and the sheet position adjusting unit is a second transmission unit 52, which transmits the sheet in the other of the first-direction transmission state and the second-direction transmission state between the sheet processing unit 3 and the sheet position adjusting unit; the transmission unit provided between the sheet processing unit 3 and the sheet collection unit 4 is the third transmission unit 53, which transmits the sheet in the one of the first-direction transmission state and the second-direction transmission state between the sheet processing unit 3 and the sheet collection unit 4.

More specifically, in the preferred embodiments according to the present invention, the first direction and the second direction orthogonal to each other in the sheet transmission path respectively corresponds to the length direction and the width direction of the rectangular paper. However, the present invention is not limited to those preferred embodiments, and the skilled in the field may also randomly select the first direction and the second direction of the sheet transmission in accordance with the needs of actual use and design.

Figure 3:
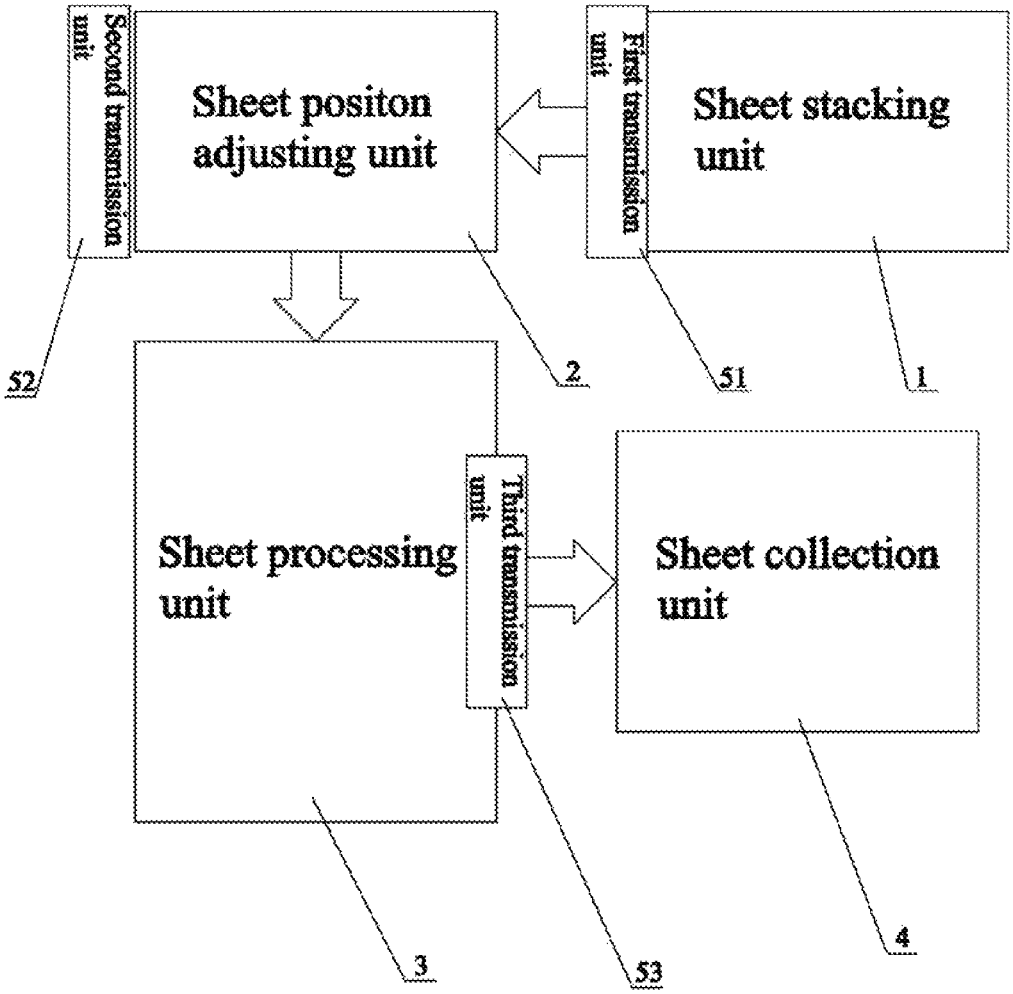
FIG. 3 shows the schematic arrangement diagram of the second embodiment according to the sheet transmission system of the present invention.

Furthermore, in the sheet transmission system according to the present invention, as shown in FIG. 3, the third transmission unit 53 can drive the sheet to freely move within the maximum limit size of the sheet processing unit 3, and when the sheet is processed by multiple times within the sheet processing unit 3, the third transmission unit 53 can drive the sheet to move within the sheet processing unit 3 so as to be processed in order.

Further on, when the sheet is processed by multiple times within the sheet processing unit 3, the time for the sheet to be processed within the sheet processing unit 3 is generally longer than that of the time to be processed once only. In this case, in order to assure that the sheet processing unit 3 can finish the predetermined processing, it may be necessary to adjust the sheet transmission speed of the first transmission unit 51 and the second transmission unit 52, so that the sheet transmission speed of the first transmission unit 51 and the second transmission unit 52 may be correspondingly adjusted according to the time for the sheet to be processed within the sheet processing unit 3, and the sheet transmission speed of the first transmission unit 51 and the second transmission unit 52 may correspond to the sheet transmission speed of the third transmission unit 53 between the sheet processing unit 3 and the sheet collection unit 4. In this way, the stacking of the sheet in the sheet transmission system as a result of the excessively fast transmission of the first transmission unit 51 and the second transmission unit 52 may be avoided. Further on, in the sheet transmission system according to the present invention, preferably the transmission speed of the sheet between the first transmission unit 51 and the second transmission unit 52 is adjusted by means of skip transmission (in present Description, the term "skip transmission" means the transmission unit is provided to transmit the paper by an interval without changing the transmission speed, i.e., transmitting one sheet by an interval of one sheet, two sheets or more sheets) or by means of reducing speed, thus to avoid the stacking of the sheet in front of the sheet processing unit 3.

More specifically, in the sheet transmission system according to a preferred embodiment of the present invention, as shown in FIG. 2, the third transmission unit 53 is provided between the sheet processing unit 3 and the sheet collection unit 4, which can drive the sheet to freely move within the sheet processing unit 3. Further, it is necessary to process the paper P for three times within the sheet processing unit 3; when the paper P is transmitted from the sheet position adjusting unit 2 to the sheet processing unit 3 via the second transmission unit 52, the third transmission unit 53 drives the paper P to move within the sheet processing unit 3, so that the pieces of paper P may be processed for three times in order within the sheet processing unit 3, so as to complete the predetermined processing. More specifically, in the preferred embodiments according to the present invention, the third transmission unit 53 first drives the paper P to enter the first processing position 31 of the sheet processing unit 3 so that the sheet is first processed at the first processing location 31; after the first processing is completed, the third transmission unit 53 again drives the paper P to enter the second processing position 32 and the third processing position 33 of the sheet processing unit 3 in order, thus to complete the second processing and the third processing respectively conducted at the second processing position 32 and the third processing position 33 (as shown by the single-line arrow in FIG. 2). After the third processing at the third processing position 33 is completed, the third transmission unit 53 will conduct the one of the first-direction transmission state and the second-direction transmission state between the sheet processing unit 3 and the sheet collection unit 4, so as to transmit the sheet to the sheet collection unit 4.

More specifically, in the preferred embodiments according to the present invention, the transmission speed of the sheet between the first transmission unit 51 and the second transmission unit 52 is adjusted by means of skip transmission. More specifically, given that it is necessary for the sheet processing unit 3 to process the paper P for three times, which requires the same processing time respectively, the first transmission unit 51 and the second transmission unit 52 transmit the sheet by means of transmitting one sheet by an interval of two sheets without having to adjust the transmission speed of the first transmission unit 51 and the second transmission unit 52. Further on, in the sheet transmission system according to the present invention, if the transmission speed of sheet of the first transmission unit 51 and the second transmission unit 52 is adjusted by means of skip transmission, and the calculation may be conducted by the following formula:

$$Y=X-1;$$

wherein, Y is the number of the sheet as the interval in sheet transmission between the first transmission unit 51 and the second transmission unit 52;

X is the number of times for processing the sheet by the third processing unit 3.

Further on, in above preferred embodiments, the sheet processing unit 3 processes the sheet for three times, however, the present invention is not limited to those preferred embodiments; the number of the sheet being processed may be one or more, and the skilled in the field may determine the number of the processing time to be conducted to the sheet in the sheet processing unit 3 in accordance with the needs of actual use and design, as long as they can assure that the sheet to finish the predetermined processing within the sheet processing unit 3. Further on, in above preferred embodiments, the transmission speed of the first transmission unit 51 and the second transmission unit 52 is adjusted by means of skip transmission, however, the present invention is not limited to those preferred embodiments; the skilled in the field may adjust the transmission speed of the first transmission unit 51 and the second transmission unit 52 by any means in accordance with the needs of actual use and design, as long as they can assure that the sheet transmission speed of the first transmission unit 51 and the second transmission unit 52 corresponds to the sheet transmission speed of the third transmission unit 53 between the sheet processing unit 3 and the sheet collection unit 4.

Further on, in the sheet transmission system according to the present invention, the first transmission unit 51 is an adsorption transmission unit, which transmits the sheet by means of adsorbing one side surface of the sheet. More specifically, the adsorption transmission unit comprises a movable base, a servo motor and a linear guiderail, the movable base is movably provided on the linear guiderail, and conducts the reciprocating movement along the linear guiderail as driven by the servo motor and is usually provided with at least one chuck to adsorb one side surface of the sheet. More specifically, in the preferred embodiments according to the present invention, when the paper is transmitted to the first transmission unit 51 which is provided with an chuck, the chuck of the first transmission unit 51 adsorbs one side surface of the sheet and thus fixes the paper relative to the movable base of the first transmission unit 51, upon which the servo motor is driven and further drives the movable base to conduct the reciprocating motion along the linear guiderail. In this way, the first transmission unit 51 transmits the paper from the sheet stacking unit 1 to the sheet position adjusting unit 2. After the paper is transmitted to the sheet position adjusting unit 2, the servo motor is driven reversely and further drives the movable base to return to its initial position along the linear guiderail and to continue the following transmission of the paper to be processed.

Further on, in the sheet transmission system according to the present invention, at least one of the transmission units is a gripping transmission unit, which transmits the sheet by means of gripping the edge of the sheet. More specifically, in the preferred embodiments according to the present invention, the paper is transmitted between two adjacent units through respective transmission unit. Among these transmission units, at least one of the transmission units is a gripping transmission unit, which means that the transmission unit is provided with a gripping device which is able to grip and fix the paper on the base of itself, so that the gripping transmission unit can more reliably transmit the paper.

Further on, in the sheet transmission system according to the present invention, preferably the second transmission unit 52 is a gripping transmission unit, which transmits the sheet by means of gripping the edge of the sheet. More specifically, when the second transmission unit 52 is a gripping transmission unit, the second transmission unit 52 comprises at least one gripping part, and each gripping part comprises a movable base and a plurality of grippers fixed side by side on the movable base, the gripper is used to grip the edge of the sheet. Further on, the movable base of each gripping part is movably provided on a corresponding linear guiderail, and may conduct reciprocating movement along a corresponding linear guiderail as driven by a corresponding servo motor, thus to transmit the sheet it has gripped.

Further on, in the sheet transmission system according to the present invention, the second transmission unit 52 may comprise one or a plurality of gripping parts. When the second transmission unit 52 comprises one gripping part, after the sheet position adjusting unit 2 finishing the adjusting of the position, a plurality of grippers of the second transmission unit 52 simultaneously grip one side edge of the sheet so as to fix the paper relative to the movable base of the second transmission unit 52, upon which the servo motor is driven and further drives the movable base to conduct reciprocating movement along the linear guiderail. In this way, the second transmission unit 52 transmits the paper from the sheet position adjusting unit 2 to the sheet processing unit 3. After the paper is transmitted to the sheet processing unit 3, the servo motor is driven reversely and further drives the movable base to return to its initial position along the linear guiderail and to continue to transmit the following paper to be processed. Further on, when the second transmission unit 52 comprises a plurality of gripping parts, the working way of each gripping part is identical with that of each above gripping part, however, the plurality of gripping parts may conduct an intersected reciprocating movement relative to each other along each linear guiderail between the sheet processing unit 3 and the sheet position adjusting unit 2. It means that, the plurality of gripping parts will not grip the same sheet at the same time. In this way, the transmission of the second transmission unit 52 can be further accelerated.

Further on, in the sheet transmission system according to the present invention, preferably the third transmission unit 53 is also a gripping transmission unit, which transmits the sheet by means of gripping the edge of the sheet. Further on, when the third transmission unit 53 is a gripping transmission unit, the third transmission unit 53 comprises at least one gripping part, which further comprises a movable base, a plurality of grippers fixed side by side on the movable base and two linear guiderails arranged orthogonally to each other; the gripper are used to grip the sheets; the movable base is movably provided on one linear guiderail, and may conduct the reciprocating movement along one linear guiderail as driven by a corresponding servo motor. Further, in the third transmission unit 53, one linear guiderail is movably provided on the other linear guiderail, and may conduct the reciprocating movement along the other linear guiderail as driven by the other corresponding servo motor, thus to realize the transmission of the gripped sheet. In this way, when the second transmission unit 52 transmits the sheet to the sheet transmission unit 3, the plurality of grippers of the third transmission unit 53 simultaneously grip one side edge of the sheet to fix the paper relative to the movable base of the third transmission unit 53, upon which one servo motor is driven and further drives the movable base to conduct the reciprocating movement along one linear guiderail. Further, the other servo motor is driven according to requirements, so that one linear guiderail is driven to move along the other linear guiderail. In this way, the third transmission unit 53 can drive the sheet to freely move within the sheet processing unit 3, so as to meet the needs of multiple times processing in order by the sheet processing unit 3 as driven by the third transmission unit 53. Further, based on above construction, the processing position of the multiple processing within the sheet processing unit 3 may be randomly arranged as needed without having to being arranged along one linear guiderail or the other linear guiderail, which thus accordingly significantly improves the freedom degree of the predetermined processing of the sheet processing unit 3. For example, the positions of the multiple processing within the sheet processing unit 3 may be provided at any position within the sheet processing unit 3, and the multiple processing may even be conducted at the same position within the sheet processing unit 3, as long as the predetermined processing to the sheet may be completed within the sheet processing unit 3. Further, after the processing is all completed, one servo motor and the other servo motor are driven and further drive the gripping part to transmit the sheet to the sheet collection unit 4 along the first direction or the second direction of the transmission path. After the paper is transmitted to the sheet collection unit 4, one servo motor and the other servo motor are driven reversely and further drive the movable base to return to its initial position and to continue to transmit the following paper to be processed.

Further on, in the sheet transmission system according to the present invention, each transmission unit is controlled by a closed loop, so that the user may randomly determine the transmission speed of each transmission unit and the time of each period in accordance with the needs of actual use and design, and thus significantly improves the adjustable performance of the speed of whole sheet transmission system.

Further on, in the sheet transmission system according to the present invention, the second transmission unit 52 and the third transmission unit 53 can grip identical sheet at the same time. More specifically, the second transmission unit 52 is provided between the sheet position adjusting unit 2 and the sheet processing unit 3 and used to transmit the sheet of which the orientation has been properly adjusted to the sheet processing unit 3, so as to conduct the predetermined processing to the sheet within the sheet processing unit 3. The third transmission unit 53 is located between the sheet processing unit 3 and the sheet collection unit 4 and used to transmit the sheet which has been processed within the third transmission unit 53 from the sheet processing unit 3 to the sheet collection unit 4. Further on, when the sheet processing unit 3 processes the sheet within a relatively short period, the second transmission unit 52 grips one side edge of the sheet and transmits the sheet from the sheet position adjusting unit 2 to the sheet processing unit 3, and the third transmission unit 53 immediately grips the other side edge of the sheet, which means that both the second transmission unit 52 and the third transmission unit 53 grip the two side edges of the sheet at the same time at the sheet processing unit 3. Further, when the sheet is during or after the processing of the sheet processing unit 3, the second transmission unit 52 loosens one side edge of the sheet and returns to its initial position, while the third transmission unit transmits the sheet to the sheet collection unit 4 after the sheet is being processed. In this way, the transmission period of the second transmission unit 52 overlaps with that of the third transmission unit 53 partially, which can further accelerates the transmission of the sheet in the transmission process.

Further on, in the sheet transmission system according to the present invention, the sheet position adjusting unit 2 comprises a first detection part, a second detection part and an adjusting and positioning part. More specifically, the first detection part is used to detect the position of the edge on one side of the sheet; the second detection part is used to detect the position of the edge on the other side of the sheet; the adjusting and positioning part is used to adjust and position the position of the sheet at the sheet position adjusting unit 2 in accordance with the detection result of the first detection part and/or the second detection part. By adjusting and positioning the two side edges of the sheet, it can accurately position the paper for the convenience of subsequent processing. Further on, in the sheet transmission system according to the present invention, the first detection part detects the positions of at least two points on the edge on one side of the sheet, thus to realize the position detection of one side edge of the sheet. The second detection part detects the position of at least one point on the edge on one side of the sheet, thus to realize the position detection of the other side edge of the sheet.

Further on, in the sheet transmission system according to the present invention, the first detection part may be a laser detection part, which detects the positions of two reference detection points on the edge on one side of the sheet. Further on, the second detection part may also be a laser detection part, which detects the position of one reference detection point on the edge on the other side of the sheet.

However, the present invention is not limited to those preferred embodiments, and the skilled in the field may randomly select the part which may be used for position detection as the first detection part and the second detection part in accordance with the needs of actual use and design, like a position sensor, a light sensor, etc. Further, the way of the position detection of one side edge and the other side edge of the sheet is not limited to the position detection of the point on one side edge and the other side edge of the sheet, and the skilled in the field may randomly use the way of the position detection of one side edge and the other side edge of the sheet in accordance with the needs of actual use and design by, for example, detecting the position of the whole edge, or detecting parts of the edges in the edge, etc.

Further on, in the sheet transmission system according to the present invention, preferably the adjusting and positioning part is a diaphragm gripping part or a vacuum attraction part. The diaphragm gripping part comprises a diaphragm and a metal plate provided under the diaphragm, and by virtue of the piezoelectric characteristic of the diaphragm material, when the diaphragm receives a current, the volume of the diaphragm enlarges, and the sheet to be transmitted is gripped between the diaphragm and the metal plate and is thus driven to be moved. The vacuum attraction part comprises a vacuum tube, and uses the pressure difference between the vacuum environment inside the vacuum tube and the external atmospheric pressure to adsorb the sheet to the end of the vacuum tube and thus to drive the sheet to be moved. Further on, when the adjusting and positioning part is a diaphragm gripping part, the diaphragm gripping part grips the edge of the sheet to move the sheet, and thus adjusts and positions the position of the sheet within the sheet position adjusting unit 2; when the adjusting and positioning part is a vacuum attraction part, the vacuum attraction part attracts one side surface of the sheet to move the sheet, and thus adjusts and positions the position of the sheet within the sheet position adjusting unit 2.

More specifically, in the preferred embodiments according to the present invention, the laser detection part serving as the first detection part first detects the positions of at least two reference detection points on the edge on one side of the paper, and by detecting the positions of at least two reference detection points on the edge on one side of the paper, comparing the detected position with the preset datum position and adopting the result obtained through comparison as the detection results of the first detection part, it thus complete the sheet position detection of the first detection part. Then the other laser detection part serving as the second detection part detects the position of at least one reference detection point on the edge on the other side of the paper, and by detecting the position of at least one reference detection point on the edge on the other side of the paper, comparing the detected position with the preset datum position and adopting the result obtained through comparison as the detection result of the second detection part, it thus completes the sheet position detection by the second detection part. When the second detection part completes the position detection, the adjusting and positioning part adjusts and positions the position of the sheet within the sheet position adjusting unit 2 in accordance with the result of detection of the first detection part and the second detection part. In the preferred embodiments according to the present invention, given that the adjusting and positioning part does not need to drive the paper to move a relatively long distance within the sheet position adjusting unit 2, preferably the adjusting and positioning part is a diaphragm gripping part, so as to reduce the volume of the second transmission unit 52. However, the present invention is not limited to those preferred embodiments, and the skilled in the field may randomly select any part as the adjusting and positioning part in accordance with the needs of actual use and design, as long as the adjusting and positioning part can drive the sheet to move within the sheet position adjusting unit 2.

More specifically, in the preferred embodiments according to the present invention, the paper to be processed is stacked in advance in the sheet stacking unit 1, and given that the subsequent processing of the paper needs to be processed piece by piece, preferably the adsorption method is used to take the paper out of the sheet stacking unit 1, so as to adsorb only one piece of paper each time from the sheet stacking unit 1 and transmit it to the sheet position adjusting unit 2. In other words, preferably the first transmission unit 51 provided between the sheet stacking unit 1 and the sheet position adjusting unit 2 is an adsorption transmission unit, and the transmission direction of the first transmission unit 1 may be adjusted in accordance with the arrangement of the sheet transmission system, so that the user may select one of the first-direction transmission state and the second-direction transmission state for paper transmission in accordance with the needs of actual use and design.

Further, in the preferred embodiments according to the present invention, preferably the second transmission unit 52 provided between the sheet processing unit 3 and the sheet position adjusting unit 2 uses the gripping method for paper transmission, and preferably the third transmission unit 53 provided between the sheet processing unit 3 and the sheet collection unit 4 also uses the gripping method for paper transmission. Transmitting the paper by the gripping method can not only avoid the deflection of the paper relative to the vertical direction caused by the adsorption force in the adsorption process, but also accelerate the transmission speed and improve the production efficiency. More specifically, in the preferred embodiments according to the present invention, the grip of the second transmission unit 52 grips the one side edge of the paper to be processed (for example, the longer side of the rectangular paper) in the transmission process, and transmits the paper from the sheet position adjusting unit 2 to the sheet processing unit 3 which then uses the processing apparatus to process the paper by the predetermined process like die cutting, hot stamping, etc.; after the sheet predetermined processing is completed, the third transmission unit 53 then grips the other side edge of the paper (for example, the shorter side of the rectangular paper) and transmits the sheet to the sheet collection unit 4.

Further on, in the preferred embodiments according to the present invention, the sheet collection unit 4 may also be provided with a paper aligning device, which is mainly used to align the paper being transmitted from the transmission units and so as to stack the finished products in order.

Each transmission unit of the sheet transmission system of the present invention can be provided to transmit the sheet along the first direction or the second direction orthogonal to each other between two adjacent units in accordance with actual needs. Thus, the sheet transmission system may be randomly arranged in accordance with the production needs or the production space.

Further on, in the preferred embodiments according to the present invention, in the process of the sheet being transmitted along the sheet transmission path of the sheet transmission system, the sheet is transmitted along the horizontal direction without causing any deflection or shift in any direction other than the horizontal direction. In this way, the processing stability of the sheet and the uniformity of the product may be further guaranteed.

Further, the FIG. 3 attached to the Specification shows another example of the present invention, according to which, the transmission unit provided between the sheet stacking unit 1 and the sheet position adjusting unit 2 is the first transmission unit 51, which transmit the sheet by one of the first-direction transmission state and the second-direction transmission state between the sheet stacking unit 1 and the sheet position adjusting unit 2; the transmission unit provided between the sheet processing unit 3 and the sheet position adjusting unit 2 is the second transmission unit 52, which transmit the sheet by the other of the first-direction transmission state and the second-direction transmission state between the sheet processing unit 3 and the sheet position adjusting unit 2; the transmission unit provided between the sheet processing unit 3 and the sheet collection unit 4 is the third transmission unit 53, which transmit the sheet by the other of the first-direction transmission state and the second-direction transmission state between the sheet processing unit 3 and the sheet collection unit 4. In this way, the position of the sheet collection unit 4 relative to the sheet processing unit 3 may be changed, so as to reduce the spatial length needed by the whole sheet transmission system. In other words, compared with above preferred embodiments, the example here differs in that the sheet transmission direction of the third transmission unit 53 is changed. More specifically, on one hand, in this example, the sheet transmission direction of the second transmission unit 52 provided between the sheet processing unit 3 and the sheet position adjusting unit 2 is perpendicular to that of the third transmission unit 53 provided between the sheet processing unit 3 and the sheet collection unit 4; on the other hand, in the preferred embodiments, the sheet transmission direction of the second transmission unit 52 is parallel to that of the third transmission unit 53. Given that other parts of this example here are the same with those of the first example, they are not described here. In the example, the adjusting and positioning part adjusts and positions the position of the sheet in accordance with the result of detection by the first detection part and the second detection part. However, the present invention is not limited to the example here, and the skilled in the field may also randomly select only the first detection part or the second detection part for the position detection of the sheet within the sheet position adjusting unit 2 in accordance with the needs of actual use and design, and thus further correct the position in accordance with the result of detection.

In the sheet transmission system of the present invention, preferably the sheet is a rectangular sheet, and the first direction and the second direction respectively corresponds to the length direction and width direction of the sheet. Given that the transmission units of the sheet transmission system of the present invention have two transmission directions, the system may select either the length direction or the width direction in which the sheet is supposed to be moved in accordance with the processing needs. However, the present invention is not limited to those preferred embodiments, and the skilled in the field may also randomly select the sheet made of various materials and shapes to be transmitted by the sheet transmission system of the present invention in accordance with the needs of actual use and design, as long as they can be transmitted by the sheet transmission system.

In the sheet transmission system of the present invention, preferably the adjusting and positioning part within the sheet position adjusting unit 2 is constituted by a diaphragm gripper, so that the accurate positioning to the sheet may be realized without a relatively significant displacement. However, the present invention is not limited to those preferred embodiments, and the skilled in the field may also randomly select any structure as the adjusting and positioning part in accordance with the needs of actual use and design, as long as the adjusting and positioning part selected can be used to adjust and position the position of the sheet within the sheet position adjusting unit 2 in accordance with the result of detection by the first detection part and/or the second detection part.

The present invention also provides a paper processing apparatus, which comprises the sheet transmission system of the Specification and can realize the automation of paper processing.

In the actual production, taking paper processing as an example, it is necessary to arrange the sheet transmission system before processing the paper, and given that the apparatus can make a turn, it may be arranged in accordance with the spatial requirements or processing needs. After such arrangement, the paper to be processed are stacked in order within the sheet stacking unit 1, and transmitted to the sheet position adjusting unit 2 by an adsorption transmission unit; then the paper is further transmitted to the sheet processing unit 3 by a gripping transmission unit; after the processing to the paper is completed, a gripping transmission unit is used to transmit the paper to the sheet collection unit 4, and the processing to the paper is thus completed.

In conclusion, the sheet transmission system in the present invention is simple in structure, and the transmission position may be randomly and flexibly arranged in accordance with the production workshop. Besides, the paper processing apparatus comprising the sheet transmission system as related to in the present invention may also randomly arranged in spatial location, and features of accurately positioning and high product qualified rate. Thus, the present invention has a high and extensive promotion value.

The examples are cited only to demonstrate and interpret the principles and efficacies of the present invention, and do not in any way limit the present invention. Any person familiar with the technology may modify or change the above examples without prejudice to the spirit and scope of the present invention. Thus, all the equivalent modifications and changes to the present invention made by any person with common knowledge in the field without breaking away from the spirits and technical ideas disclosed by the present invention shall fall within the scope of the claims of the present invention.

I claim:

1. A sheet transmission system, comprising: a sheet stacking unit, a sheet position adjusting unit, a sheet processing unit, and a sheet collection unit, each unit arranged in series along a transmission path of a sheet; and one or more independent transmission units, each transmission unit provided between two adjacent units among above units;

wherein the sheet stacking unit is configured to store the sheet to be processed; the sheet position adjusting unit is configured to adjust the position of the sheet; the sheet processing unit is configured to conduct a predetermined process to the sheet transmitted therein; the sheet collection unit is configured to collect the processed sheet;

wherein each said transmission unit is configured to conduct reciprocating-linear movement between two adjacent units along the transmission path of the sheet, and to transmit the sheet between two adjacent units;

wherein the transmission path of the sheet comprises a first direction, a second direction orthogonal to the first-direction, a first-direction transmission state in which the sheet is transmitted along the first direction between two adjacent units and a second-direction transmission state in which the sheet is transmitted along the second direction between two adjacent units;

wherein when a sheet is transmitted along the transmission path, the sheet is subjected to at least one transition between the first-direction transmission state and the second-direction transition state;

wherein the transmission unit provided between the sheet stacking unit and the sheet position adjusting unit is a first transmission unit, the first transmission unit transmits the sheet in one of the first-direction transmission state or the second-direction transmission state between the sheet stacking unit and the sheet position adjusting unit; and the first transmission unit is an adsorption transmission unit, which transmits the sheet by adsorbing one side surface of the sheet.

2. The sheet transmission system of claim 1, wherein the transmission unit provided between the sheet processing unit and the sheet position adjusting unit is a second transmission unit, wherein the second transmission unit transmits the sheet in the other of the first-direction transmission state or the second-direction transmission state between the sheet processing unit and the sheet position adjusting unit; and the transmission unit provided between the sheet processing unit and the sheet collection unit is a third transmission unit, wherein the third transmission unit transmits the sheet in one of the first-direction transmission state or the second-direction transmission state between the sheet processing unit and the sheet collection unit.

3. The sheet transmission system of claim 1, wherein the transmission unit provided between the sheet processing unit and the sheet position adjusting unit is the second transmission unit, which transmits the sheet in the other of the first-direction transmission state and the second-direction transmission state between the sheet processing unit and the sheet position adjusting unit; and the transmission unit provided between the sheet processing unit and the sheet collection unit is the third transmission unit, which transmits the sheet in the other of the first-direction transmission state and the second-direction transmission state between the sheet processing unit and the sheet collection unit.

4. The sheet transmission system of claim 3, wherein the third transmission unit drives the sheet to freely move from the sheet processing unit.

5. The sheet transmission system of claim 4, wherein the sheet is processed multiple times within the sheet processing unit before the third transmission unit drives the sheet to move from the sheet processing unit to the sheet collection unit; and wherein a sheet transmission speed of the first transmission unit and a sheet transmission speed of the second transmission unit corresponds to a sheet transmission speed of the third transmission unit between the sheet processing unit and the sheet collection unit.

6. The sheet transmission system of claim 5, wherein the first transmission unit and the second transmission unit transmit the sheet by skip transmission or reducing sheet speed.

7. The sheet transmission system of claim 1, wherein the adsorption transmission unit comprises a movable base, a servo motor and a linear guiderail, the movable base movably provided on the linear guiderail, conducting reciprocating movement along the linear guiderail as driven by the servo motor; and wherein at least one chuck is mounted on the movable base to adsorb one side surface of the sheet.

8. The sheet transmission system of claim 7, wherein the second transmission unit is a gripping transmission unit, which transmits the sheet by gripping an edge of the sheet.

9. The sheet transmission system of claim 8, wherein the second transmission unit comprises at least one gripping part, the gripping part or parts further comprising a movable base and a plurality of grippers fixed side by side on the movable base; the movable base of the gripping part or parts movably provided on a corresponding linear guiderail, conducting reciprocating movement along the corresponding linear guiderail as driven by a corresponding servo motor.

10. The sheet transmission system of claim 9, wherein when the second transmission unit comprises a plurality of gripping parts, the plurality of gripping parts conduct intersected reciprocating movement relative to each other along each linear guiderail between the sheet processing unit and the sheet position adjusting unit.

11. The sheet transmission system of claim 9, wherein the third transmission unit is a gripping transmission unit, which transmits the sheet by gripping an edge of the sheet.

12. The sheet transmission system of claim 11, wherein the third transmission unit comprises a gripping part, which further comprises a movable base, a plurality of grippers fixed side by side on the movable base and two linear guiderails arranged orthogonally to each other;

wherein the movable base is movably provided on one linear guiderail, and conducts reciprocating movement along the one linear guiderail as driven by one corresponding servo motor; and wherein the one linear guiderail may be movably provided on the other linear guiderail, and may conduct reciprocating movement along the other linear guiderail as driven by another corresponding servo motor.

13. The sheet transmission system of claim 12, wherein the second transmission unit and the third transmission unit grip the same sheet at the same time.

14. The sheet transmission system of claim 13, wherein the sheet is transmitted along the transmission path in a horizontal direction.

15. The sheet transmission system of claim 14, wherein the sheet position adjusting unit comprises a first detection part, a second detection part and an adjusting and positioning part, the first detection part is configured to detect the location of the edge of one side of the sheet; the second detection part is configured to detect the location of the edge of the other side of the sheet; and the adjusting and positioning part is configured to adjust and position the location of the sheet within the sheet position adjusting unit in accordance with detection results of at least one of the first detection part and the second detection part.

16. The sheet transmission system of claim 15, wherein the first detection part is a laser detection part, which detects the positions of two reference detection points on the edge of one side of the sheet.

17. The sheet transmission system of claim 16, wherein the second detection part is a laser detection part, which detects the position of one reference detection point on the edge of the other side of the sheet.

18. The sheet transmission system of claim 16, wherein the adjusting and positioning part is a diaphragm gripping part or a vacuum attraction part; wherein, when the adjusting and positioning part is a diaphragm gripping part, the diaphragm gripping part grips the edge of the sheet to drive the sheet to move so as to adjust and locate the position of the sheet within the sheet position adjusting unit;

when the adjusting and positioning part is a vacuum attraction part, the vacuum attraction part attracts one side surface of the sheet to drive the sheet to move so as to adjust and locate the position of the sheet within the sheet position adjusting unit.

19. A paper processing device, comprising: the sheet transmission system according to claim 1.

* * * * *